US006068507A

United States Patent [19]

Popa

[11] Patent Number: 6,068,507

[45] **Date of Patent: *May 30, 2000**

[54] HOUSING ADAPTED TO AN ELECTRICAL CONNECTOR POSITION ASSURANCE SYSTEM

[75] Inventor: Alexander Popa, Karlsbad, Germany

[73] Assignee: Molex Incorporated, Lisle, Ill.

[ * ] Notice: This patent issued on a continued prosecution application filed under 37 CFR 1.53(d), and is subject to the twenty year patent term provisions of 35 U.S.C. 154(a)(2).

[21] Appl. No.: 08/960,424

[22] Filed: Oct. 31, 1997

[30] Foreign Application Priority Data

Nov. 4, 1996 [EP] European Pat. Off. ..... 96117610

[51] Int. Cl.[7] ..... H01R 3/00

[52] U.S. Cl. ..... 439/489; 439/352

[58] Field of Search ..... 439/488, 489, 439/352, 353, 354, 357

[56] References Cited

U.S. PATENT DOCUMENTS

| | | | |
|---|---|---|---|
| 4,925,398 | 5/1990 | Samejima et al. | 439/357 |
| 4,946,404 | 8/1990 | Takenouchi et al. | 439/352 |
| 5,112,243 | 5/1992 | Chow et al. | 439/352 |
| 5,203,718 | 4/1993 | Chishima | 439/489 |
| 5,203,719 | 4/1993 | Kozona | 439/489 |
| 5,217,390 | 6/1993 | Nozaki et al. | 439/489 |
| 5,330,369 | 7/1994 | Nozaki et al. | 439/489 |
| 5,507,666 | 4/1996 | Yamanashi | 439/489 |
| 5,643,003 | 7/1997 | Myer et al. | 439/352 |
| 5,672,073 | 9/1997 | Matsumura et al. | 439/188 X |
| 5,681,178 | 10/1997 | Kunkle et al. | 439/352 |
| 5,688,142 | 11/1997 | Dietz et al. | 439/352 X |
| 5,839,915 | 11/1998 | Ford et al. | 439/350 X |

FOREIGN PATENT DOCUMENTS 0717465 6/1996 European Pat. Off. ..... H01R 13/506

*Primary Examiner*—Khiem Nguyen
*Attorney, Agent, or Firm*—A. A. Tirva

[57] ABSTRACT

A housing adapted to a connector position assurance system is incorporated in an electrical connector assembly. A first electrical connector includes a housing having a latch portion and an activating portion. A second electrical connector is mateable with the first connector and includes said housing having a latching member movable into engagement with the latch portion of the first connector when the connectors are mated. A connector position assurance device (CPA) is mounted on the latching member for movement relative thereto between an initial inactive position and a final indicating position to indicate that the connectors are mated. Complementary interengaging stops are provided between the CPA and the latching member to prevent the CPA from moving from its initial position to its final position when the connectors are not mated.

5 Claims, 4 Drawing Sheets

HOUSING ADAPTED TO AN ELECTRICAL CONNECTOR POSITION ASSURANCE SYSTEM

FIELD OF THE INVENTION

This invention generally relates to the art of electrical connectors and, particularly, to a connector housing being adapted to a position assurance system in an electrical connector assembly.

BACKGROUND OF THE INVENTION

There often is a need to provide secure mechanical and electrical engagement between a pair of mateable electrical connectors or between an electrical connector and another mateable electrical device. Various latching techniques have been used to provide the secure engagement.

In addition, various uses of electrical connectors require that some form of assurance system be provided which absolutely assures that the connectors are fully mated and can be used to indicate such mating. For instance, in an electrical circuit system for automobiles or other vehicles, such as in a safety circuit for an air bag, there is concern directly for human life in the event of an emergency. Therefore, it is necessary to take measures to prevent incomplete fitting and locking or an incomplete mating of electrical connectors in the wiring circuit.

The present invention is directed to providing a simple, efficient and cost effective connector housing adapted to an assurance system for electrical connectors of the character described above. In addition it is intended according to the invention to provide a connector housing having only a small number of parts and facilitating mounting of a position assurance system to an electrical connector assembly.

SUMMARY OF THE INVENTION

An object, therefore, of the invention is to provide a new and improved connector housing adapted to a connector position assurance system in an electrical connector assembly.

In the exemplary embodiment the invention, is directed to, a first electrical connector including a housing having a latch portion and an activating portion. A second electrical connector is mateable with the first connector and includes the inventive housing having a latching member movable into engagement with the latch portion of the first connector when the connectors are mated. A connector position assurance device (CPA) is mounted on the latching member according to the present invention for movement relative thereto between an initial inactive position and a final indicating position to indicate that the connectors are mated.

The invention contemplates the provision of complementary interengaging stop means between the CPA and the latching member to prevent the CPA from moving from its initial position to its final position when the connectors are not mated.

Still further, the CPA is located in its final position blocking movement of the latching member out of engagement with the latch portion of the first connector. Specifically, the CPA includes a blocking tongue engageable with a ledge on the first connector in a position to block movement of the latching member out of engagement with the latch portion when the CPA is in its final position.

As disclosed herein, the CPA is slidably mounted on the latch member for movement between its initial and final positions. The latch member is pivotally mounted on the housing of the second connector for pivoting movement into and out of engagement with the latch portion of the first connector. The complementary interengaging stop means include a spring loaded stop arm on the CPA biased into engagement with a stop shoulder on the latching member. The activating portion on the first connector comprises a boss effective to move the stop arm out of engagement with the stop shoulder when the connectors are mated, thereby allowing the CPA to move from its initial position to its final position.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
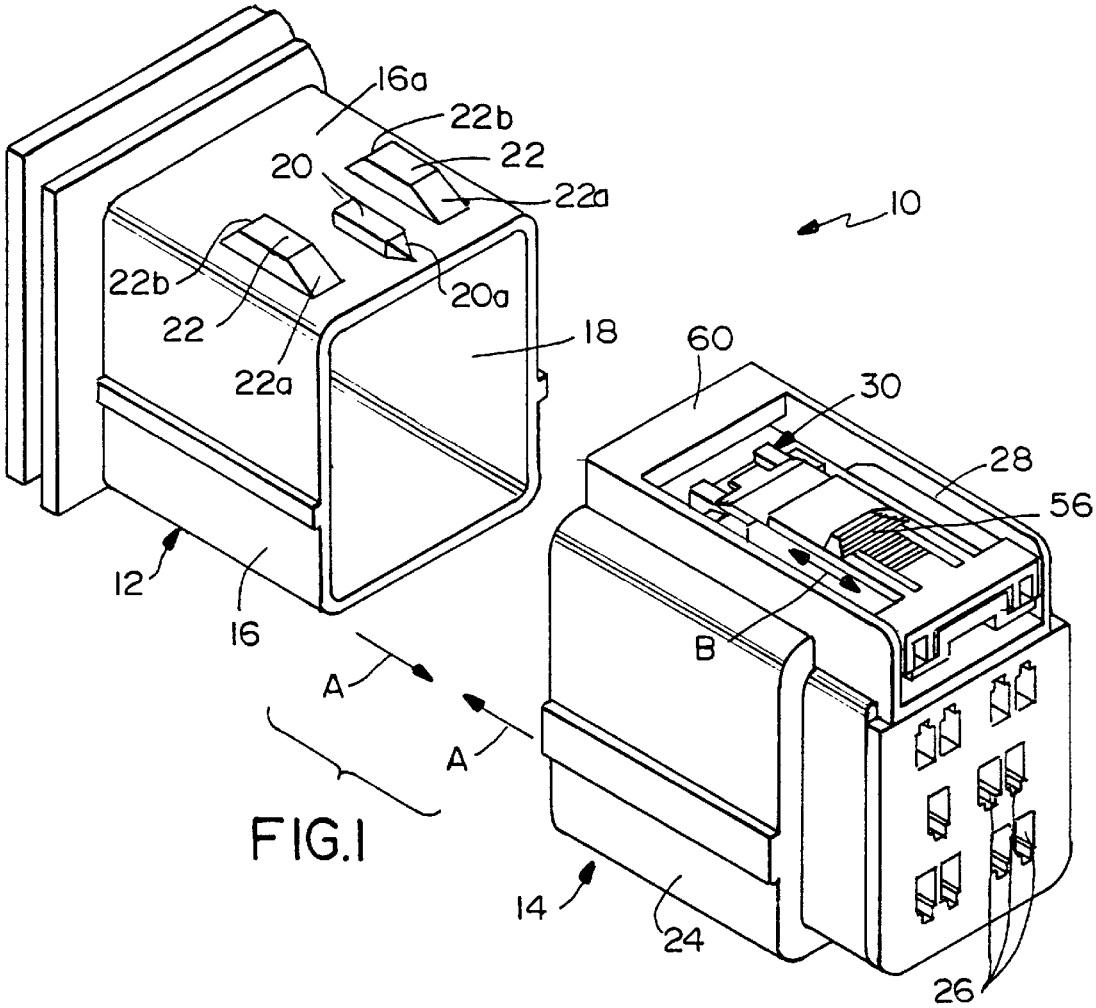
FIG. 1 is a perspective view of a pair of mating connectors in an electrical connector assembly embodying the connector housing of the invention being adapted to a connector position assurance system.

Referring to the drawings in greater detail, and first to FIG. 1, the housing (24) of the invention being adapted to a connector position assurance system is embodied in an electrical connector assembly, generally designated 10, which includes a first connector, generally designated 12, and a second connector, generally designated 14. The connectors are mateable in the direction of arrows "A".

First connector 12 includes a housing 16 defining a receptacle 18. The housing/receptacle is generally rectangular and includes a top wall 16*a*. A latch boss 20, having a forwardly facing chamfered surface 20*a*, is located generally centrally of and projects upwardly from top wall 16*a*. A pair of activating bosses 22 also project upwardly on opposite sides of latch boss 20. Each activating boss 22 includes a forwardly facing chamfered surface 22*a* and a rearwardly facing chamfered surface 22*b*. Although not visible in the drawings, a plurality of pin terminals project forwardly within receptacle 18 of first connector 12.

Second connector 14 is a plug connector having a portion receivable in receptacle 18 of connector 12. The second connector includes the housing 24 having a plurality of terminal-receiving passages 26 within which are mounted a plurality of female terminals for interengagement with the pin terminals within receptacle 18 of the first connector. A connector position assurance device (CPA), generally designated 28, is slidably mounted on a latching member, generally designated 30, on top of second connector 14. The CPA is movable relative to the latching member in the direction of double-headed arrow "B".

Figure 2:
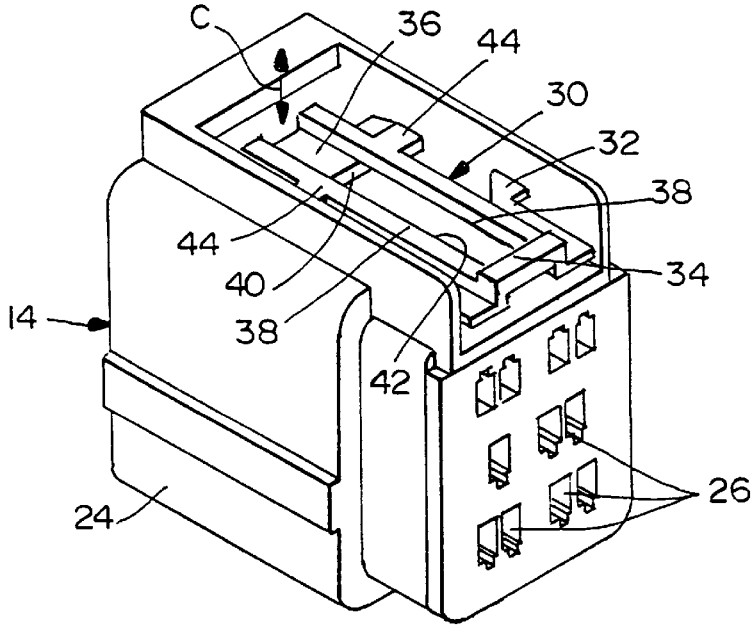
FIG. 2 is a perspective view similar to that of FIG. 1, with the CPA removed from the second connector to facilitate the illustration.

Referring to FIG. 2 in conjunction with FIG. 1, CPA 28 (FIG. 1) has been removed to facilitate a better illustration of latching member 30 of the invention. More particularly, housing 24 of second connector 14 is unitarily molded of dielectric material, such as plastic or the like, and latching member 30 is mounted to the top of the housing by a pair of integral pivots 32 which define fulcrums about which the latch member is pivotable in the direction of double-headed arrow "C". A rear end 34 of latching member 30 is accessible by an operator's finger so that pushing down on rear end 34 will cause a front end 36 of the latch member to pivot upwardly. A pair of arms 38 extend front-to-rear of latching member 30, and a latch shoulder 40 spans the arms at the front of a slot 42. The latch shoulder is at an elevation below the tops of arms 38. A pair of stop wings 44 project outwardly from arms 38 of latch member 30.

Figure 3:
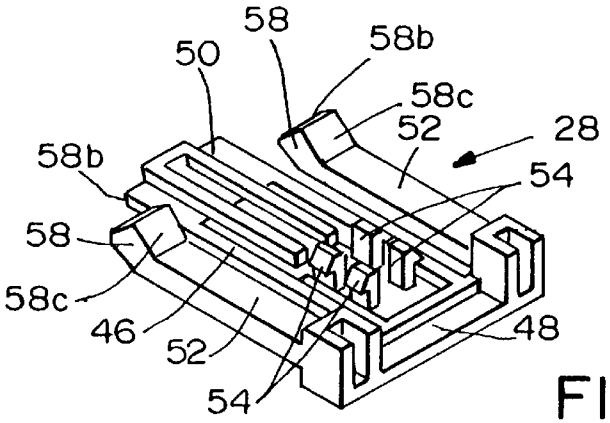
FIG. 3 is a perspective view of the underside of the CPA.
Figure 4:
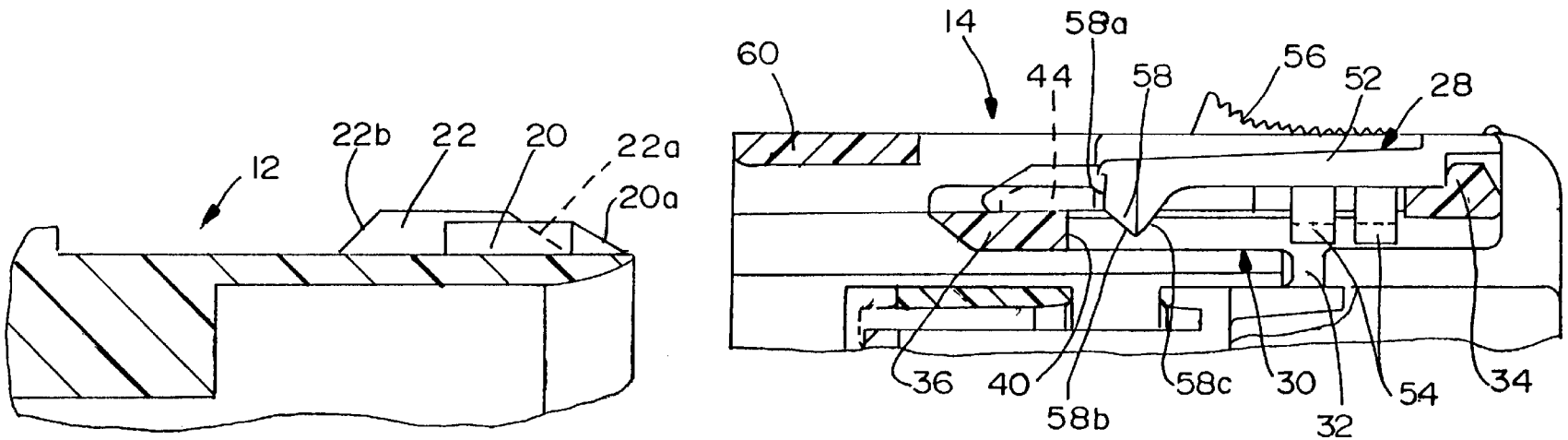
FIG. 4 is a fragmented section taken in the axial or mating direction through the connectors prior to mating of the connectors and with the CPA in its initial position.

Referring to FIG. 3 in conjunction with FIGS. 1 and 2, CPA 28 includes a central body portion 46 cantilevered from a cross base portion 48. The central body portion has a distal end 50 which defines a blocking tongue, for purposes described hereinafter. A pair of stop arms 52 also project forwardly from cross base portion 48 on opposite sides of central body portion 46. Lastly, four hooked mounting tabs 54 project downwardly from central body portion 46.

The hooked mounting tabs project through slot 42 (FIG. 2) in latching member 30 and the hooked portions of the mounting tabs snap beneath the underside of the latching member. Therefore, hooked mounting tabs 54 of CPA 28 received in slot 42 of latching member 30 provide a means for slidably mounting the CPA on the latching member for movement relative to the latching member in the direction of double-headed arrow "B" (FIG. 1). FIG. 1 shows that the top of the CPA is provided with a serrated ramp 56 to facilitate movement of the CPA, as by an operator's thumb or finger.

FIGS. 4–8 show various sequential positions of first connector 12, second connector 14, latching member 30 and CPA 28 during a mating operation of the connectors. Before proceeding with a description of that operation, and referring to FIG. 4, each stop arm 52 of CPA 28 is provided with a downwardly projecting hook 58 at the forward distal end thereof. The hook defines a forwardly facing stop surface 58*a*, a forwardly and downwardly chamfered surface 58*b* and a rearwardly facing chamfered surface 58*c*.

Turning now to the mating of the connectors and the operation of the connector position assurance system, FIG. 1 shows first connector 12 and second connector 14 in completely unmated condition. Latching member 30 is in its static or inoperative position, and CPA 28 is in its retracted or rear initial inactive position.

Figure 5:
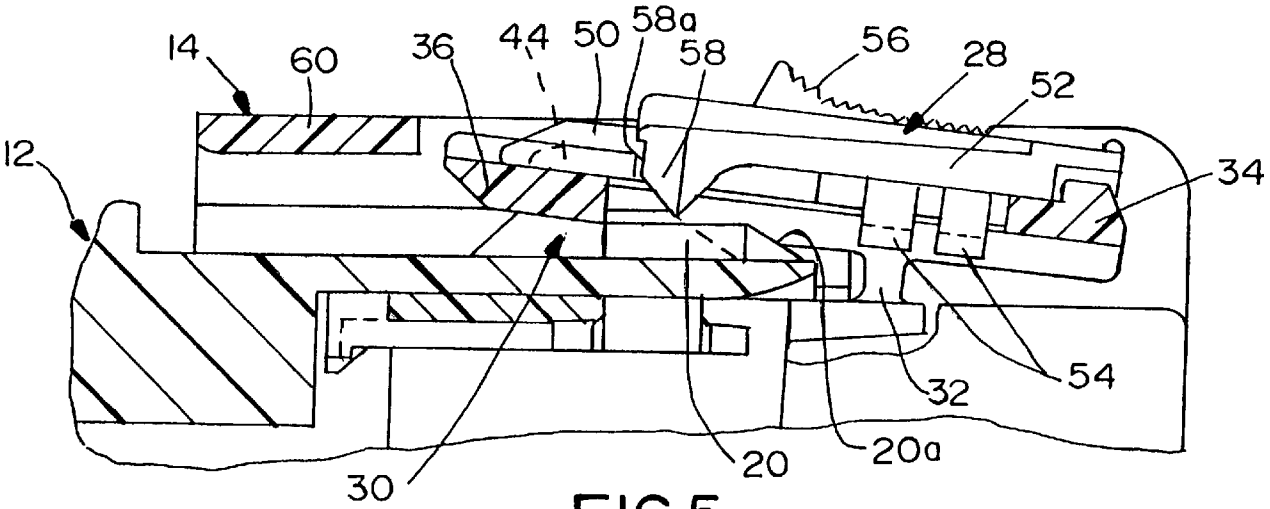
FIG. 5 is a sequential view similar to that of FIG. 4, with the connectors partially mated, with the latching member in an intermediate position, and with the CPA still in its initial position.

FIG. 5 shows first connector 12 and second connector 14 only partially mated. In this position, front end 36 of latching member 30 has moved up chamfered surface 20*a* of latch boss 20 and is resting on top of the boss. During this movement, stop wings 44 (FIG. 2) at the sides of the latching member (which are not visible in FIG. 5) clear activating bosses 22 of first connector 12 and are not interfered thereby. In this intermediate mating condition of the connectors shown in FIG. 5, CPA 28 still is in its rearward or initial inactive position. It should be noted in FIGS. 4 and 5 that CPA 20 cannot move forwardly because stop surfaces 58*a* of stop arms 52 will abut against the rear edges of stop wings 44 of latching member 30. This provides a complementary interengaging stop means between the CPA and the latching member to prevent the CPA from moving from its initial position to its final position when the connectors are not mated.

Figure 6:
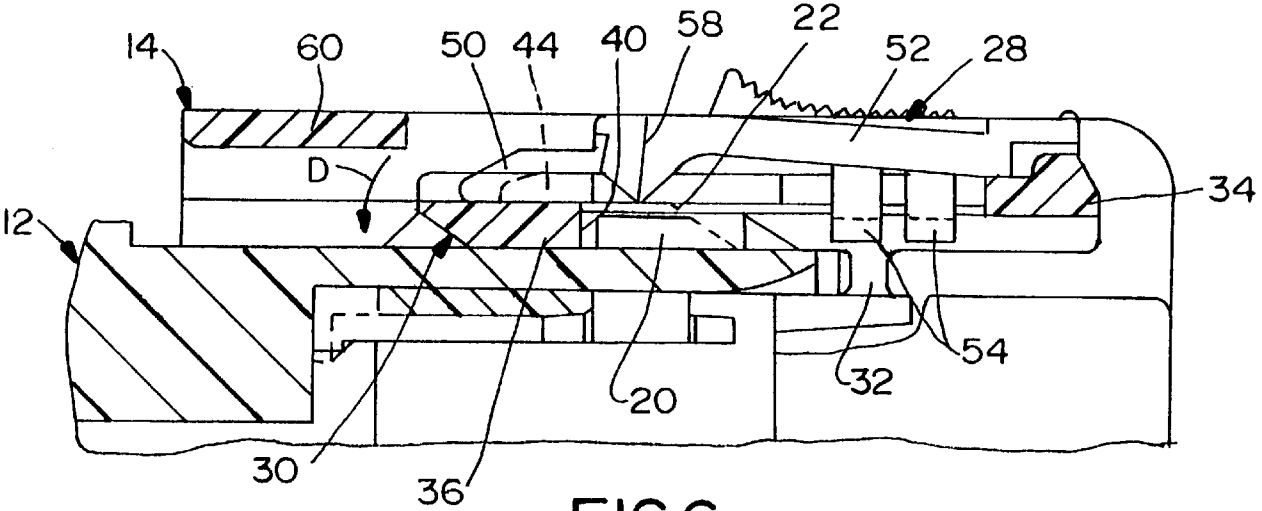
FIG. 6 is a sequential view similar to that of FIG. 5, with the latching member fully latched and the connectors fully mated, but with the CPA in its activated position.

FIG. 6 shows first and second connectors 12 and 14, respectively, in their fully mated position. Front end 37 of latching member 30 now has dropped downwardly in the direction of arrow "D", and latch shoulder 40 now has dropped behind the abrupt front end of latch boss 20.

In this position, the connectors cannot be unmated simply by pulling the connectors apart. The only way that they can be unmated is by pushing down on rear end 34 of latching member 30 to pivot front end 36 and latch shoulder 40 back upwardly sufficiently to clear latch boss 20. However, it can be seen that stop arms 52 remain in an elevated position because hook portions 58 of the stop arms now are resting on top of activating bosses 22. In other words, the activating bosses of the first connector are effective to release the stop means which prevents the CPA from moving forwardly.

Figure 7:
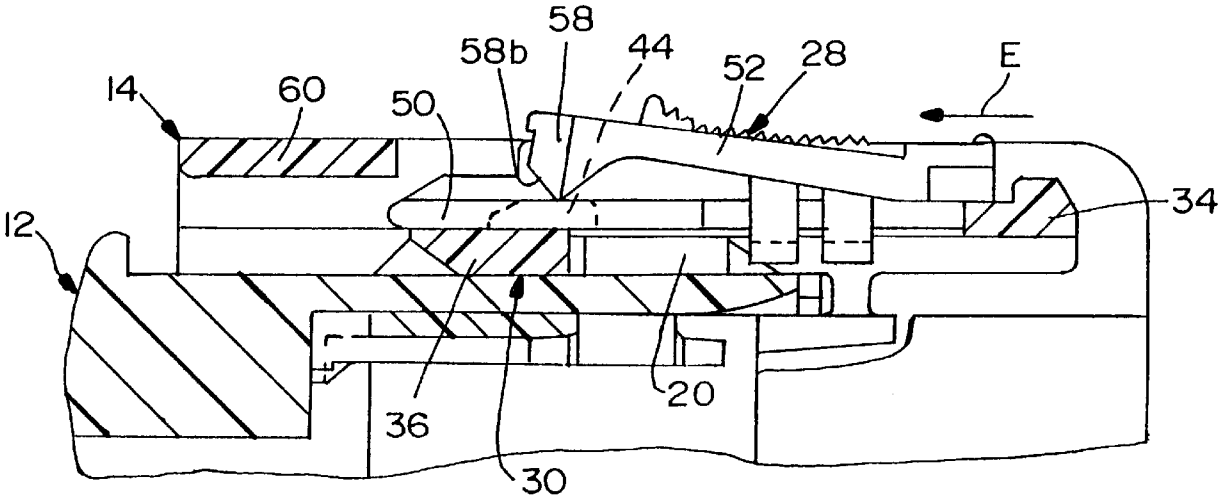
FIG. 7 is a sequential view similar to that of FIG. 6, with the CPA being moved toward its final position.

FIG. 7 shows first and second connectors 12 and 14, respectively, still in fully mated condition, and with front end 36 of latching member 30 latched behind latch boss 20 of the first connector. However, CPA 28 has been moved forwardly in the direction of arrow "E" away from its initial position and to an intermediate position whereat chamfered surfaces 58*b* at the front end of stop arms 52 have moved over stop wings 44 of the latching member until the hook portions 58 of stop arms 52 have moved onto the tops of stop wings 44.

FIG. 8 again shows the fully mated condition of first and second connectors 12 and 14, respectively, but CPA 28 has now been moved completely forwardly in the direction of arrow "F" to its final indicating position which indicates that the connectors are fully mated. Stop arms 52 have dropped downwardly in the direction of arrow "G", as hook portions 58 of the stop arms move forwardly of and clear stop wings 44 of latching member 30.

Figure 8:
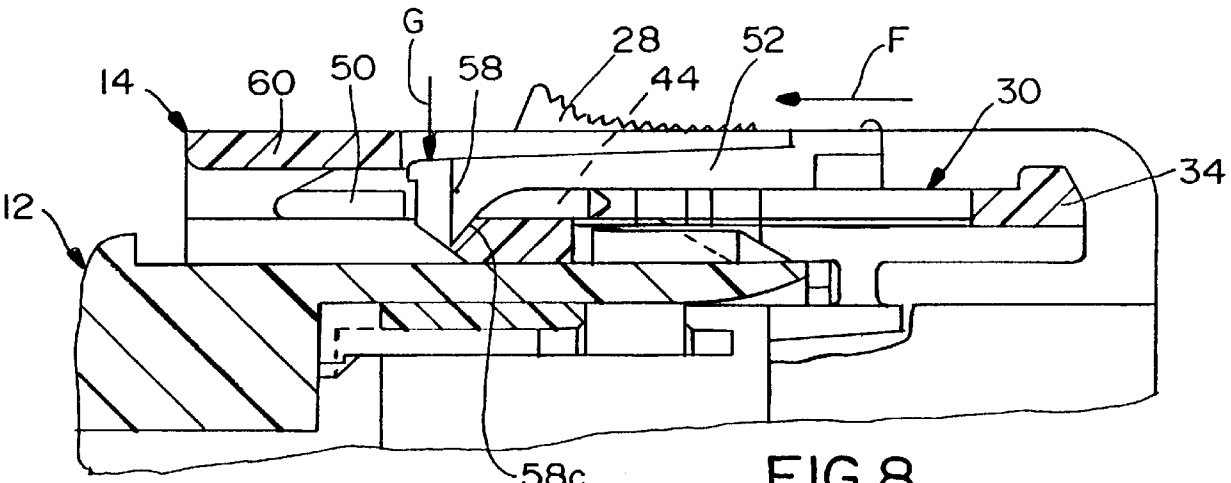
FIG. 8 is a sequential view similar to that of FIG. 7, with the CPA now in its final position while the connectors are fully mated.

It should be noted that in the final position of CPA 28 as shown in FIG. 8, blocking tongue 50 at the front of the CPA has moved under a ledge 60 which forms a part of housing 24 of second connector 14, as seen in FIGS. 1 and 2. Therefore, if any attempt is made to unlatch the connectors by pushing down on rear end 34 of latching member 30, the latching member cannot be pivoted away from its latched condition because blocking tongue 50, being seated beneath ledge 60, prevents the entire assembly of the latching member and the CPA from pivoting away from the final latched condition of the components.

In order to unlatch the connectors, CPA 28 is moved back rearwardly opposite the direction of arrow "F" (FIG. 8) to cause rearwardly facing chamfered surfaces 58*c* of hook portions 58 of the CPA to ride over the tops of stop wings 44 and allow the CPA to move back to its initial position. After the CPA is moved back rearwardly relative to latching member 30, the front blocking tongue 50 of the CPA moves out of engagement beneath ledge 60, whereby latching member 30 can be pivoted away from its latched position, and the connectors can be unmated.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A connector position assurance system in an electrical connector assembly, comprising:

a first electrical connector including a first housing have a center latch boss and a pair of activating bosses on opposite sides of the latch boss;

a second electrical connector mateable with the first connector and including a second housing;

a latching member on the second connector and having a center latch portion movable into engagement with the center latch boss of the first connector when the connectors are mated and a pair of stop portions on opposite sides of the latch portion; and a connector position assurance device (CPA) mounted on the latching member for movement relative thereto between an initial inactive position and a final indicating position to indicate that the connectors are mated, the CPA including a center blocking portion for preventing the center latch portion of the latching member from disengaging from the center latch boss of the first connector when the CPA is in its final indicating position, a pair of spring loaded stop arms on opposite sides of the center blocking portion biased into engagement with stop portions of the latching member to prevent the CPA from moving from its initial position to its final position when the connectors are not mated, and said activating bosses of the first connector moving the stop arms out of engagement with the stop portions of the latching member when the connectors are mated to allow the CPA to move from its initial position to its final position.

2. The connector position assurance system of claim 1, including mounting means slidably mounting the CPA on the latching member for movement between said positions.

3. The connector position assurance system of claim 2 wherein said mounting means comprise snap-type mounting means to provide for ready removal of the CPA even when the connectors are mated.

4. The connector position assurance system of claim 1, including means mounting the latching member on the second housing for pivoting movement into and out of engagement with the latch boss of the first connector.

5. The connector position assurance system of claim 1, wherein said blocking portion of the CPA comprises a tongue engageable beneath a ledge of the first connector.

* * * * *